US008490656B2

(12) United States Patent
Lehmann

(10) Patent No.: US 8,490,656 B2
(45) Date of Patent: Jul. 23, 2013

(54) METHOD FOR OPERATING A WEAVING MACHINE COMPRISING A SHEDDING MACHINE

(75) Inventor: Michael Lehmann, Eriskirch (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 98 days.

(21) Appl. No.: 13/201,345

(22) PCT Filed: Mar. 6, 2009

(86) PCT No.: PCT/DE2009/000296

§ 371 (c)(1),
(2), (4) Date: Aug. 12, 2011

(87) PCT Pub. No.: WO2010/099766

PCT Pub. Date: Sep. 10, 2010

(65) Prior Publication Data

US 2011/0290368 A1 Dec. 1, 2011

(51) Int. Cl.

| | |
|---|---|
| ***D03D 51/14*** | (2006.01) |
| ***D03D 51/46*** | (2006.01) |
| *D03D 51/00* | (2006.01) |
| *D03D 51/44* | (2006.01) |

(52) U.S. Cl.
USPC ..... 139/1 E; 139/11; 139/35; 139/55.1; 139/56; 139/116.2

(58) Field of Classification Search
None
See application file for complete search history.

(56) References Cited

U.S. PATENT DOCUMENTS

| | | | | |
|---|---|---|---|---|
| 4,392,515 | A * | 7/1983 | Moessinger | 139/55.1 |
| 4,523,915 | A * | 6/1985 | Mutschler | 464/3 |
| 4,669,510 | A * | 6/1987 | Speich | 139/1 E |
| 5,335,698 | A * | 8/1994 | Berktold et al. | 139/1 E |
| 6,953,063 | B2 * | 10/2005 | Krumm et al. | 139/1 E |
| 2003/0070721 | A1 * | 4/2003 | Wahhoud | 139/435.1 |

FOREIGN PATENT DOCUMENTS

| | | |
|---|---|---|
| DE | 34 36 165 | 5/1985 |
| EP | 0 570 628 | 11/1993 |
| EP | 0 893 525 | 1/1999 |
| EP | 1 328 673 | 7/2003 |
| WO | WO 02/34982 | 5/2002 |

OTHER PUBLICATIONS

International Search Report of the International Searching Authority for International Application PCT/DE2009/000296, mailed Feb. 23, 2010, 2 pages, European Patent Office, HV Rijswijk, Netherlands.

(Continued)

*Primary Examiner* — Bobby Muromoto, Jr.
(74) *Attorney, Agent, or Firm* — W. F. Fasse

(57) ABSTRACT

A weaving apparatus includes a weaving machine and a shedding machine that carries out activatable and deactivatable movements of the shedding devices with a shedding drive that is controlled independently of a weaving drive of the weaving machine. After detection of an operating malfunction, e.g. a weft fault or a warp fault, the shedding devices are controlled such that measures for eliminating the operating malfunction can be carried out. In that regard, the rotational speed of the weaving machine is reduced, but the shedding machine is further operated at a relatively high rotational speed, preferably without stopping the shedding machine while the malfunction is eliminated. Then, the speed of the weaving machine is increased and again essentially synchronized with the shedding machine, to resume the regular weaving operation.

16 Claims, 7 Drawing Sheets

OTHER PUBLICATIONS

English Translation of PCT International Preliminary Report on Patentability, including the Written Opinion of the International Searching Authority for International Application PCT/DE2009/000296, issued Sep. 20, 2011, 5 pages, International Bureau of WIPO, Geneva, Switzerland.

* cited by examiner

METHOD FOR OPERATING A WEAVING MACHINE COMPRISING A SHEDDING MACHINE

FIELD OF THE INVENTION

The invention relates to a method for operating a weaving machine with a shedding machine, which comprises activatable and deactivatable movements of the shedding means and is driven by a single rotational speed-changeable drive, which is controlled or actuated independently of a rotational speed-changeable drive of the weaving machine.

BACKGROUND INFORMATION

The shedding machine is of the type that the movements of the individual shedding means, for example heald frames or Jacquard hooks or wires, can be controlled, that is to say activated or deactivated, through an electronic control in an individually programmable manner by electromechanical elements. Such shedding machines are known to the skilled worker under the name dobby or Jacquard machine. In dobby or Jacquard machines in the sense of this invention, a drive of the main shaft of the shedding machine and rotating masses of the shedding machine connected therewith, including possibly present additional inertial or balancing masses, is possible independent of the actuatable movement of the shedding means. A dobby machine that works according to this principle is described, for example, in the EP 570 628 A1. In contrast to shedding machines in which each shedding means comprises its own motor, a shedding machine as it is pertinent here as an underlying basis needs only a single drive motor.

Moreover, in the present method, one speaks of electric motorized drives which have a changeable rotational speed through an electronic control, and which are able to drive the weaving and the shedding machine with their regular operating rotational speed.

An independent motorized drive of the shedding machine makes it possible, in certain operating conditions, to suspend the operation, which is essentially synchronous in normal weaving operation, of the shedding machine and weaving machine. At this point, reference is made to the fact that both the weaving machine as well as the shedding machine have components that are moved unequally or irregularly or non-continuously in most cases via drive means. In the weaving machine these are usually the components for the reed beat-up and if applicable components for the mechanical weft insertion. In the shedding machine these are the shedding means. The irregular movements of these components cause inertial moments that fluctuate independently of one another on the shaft of the respective drive motor. These in turn cause fluctuating rotational speeds over respectively one operating or working cycle of the weaving and shedding machine. Depending on the size of the drive units and depending on how the associated drive control is laid out or designed in terms of the regulation technology, these fluctuations turn out larger or smaller. This factual situation is described, among other things, in the EP 0 893 525 A1. That means that the weaving and the shedding machine with drive motors that are independent of one another, generally over the course of one working cycle are angularly synchronous and physically exactly at the same rotational speed only at certain functionally absolutely necessary time points. In other angular ranges of a working cycle, it is permissible to deviate from this exact synchronicity. In this regard, an essentially synchronous operating manner means that e.g. within one working cycle the instantaneous rotational speed of weaving or shedding machine amounts to only 85% of the actual operating rotational speed, however that both machines run with the same operating rotational speed when averaged over several working cycles. For the described operating manner it is necessary that the weaving and shedding machine, or their drives in connection with the associated electronic control or regulating arrangements including rotational angle transducers or other sensors, are equipped to allow a determination of the instantaneous position of weaving and shedding machine as well as a synchronizing of both.

PRIOR ART

A method of operating a weaving machine with a shedding machine with drives independent from one another is known from the EP 1 328 673 B1. This includes the suggestion, that the running-up of the shedding machine can take place without the motion of the shedding means and without motion of the weaving machine. That has the advantage that the drive moments on the shedding machine are reduced, because the time for the run-up of the shedding machine with its rotational masses including possibly present inertial or balancing masses can be longer than with a synchronous run-up of weaving and shedding machine; moreover the masses of the shedding means are not moved along in this process. Furthermore the suggestion according to the EP 1 328 673 B1 rests on the consideration that the weaving machine is operated in such a manner during the run-up process of the weaving and shedding machine, that no "empty" reed beat-ups against the binding or interlacing point of the woven web are carried out before the first reed beat-up with a rotational speed that is near or equal to the operating rotational speed, because this can lead to an undesired compressing of the woven web and to a micro-roughening of the weft and warp threads at the interlacing point.

Beginning from the method according to the EP 1 328 673 B1, considerations were established, that it is not the same or indifferent regarding in which position the shedding means come to a standstill if the weaving operation must be interrupted due to a weft thread break or a warp thread break. With a weft thread break, for example, the open position of the loom shed is necessary so that the broken weft thread or threads can be removed. The open position of the loom shed means that all shedding means are positioned in one of the two extreme positions of the motion (high or low). A longer standstill of the weaving machine or of the shedding means in the open position of the loom shed is, however, disadvantageous for the quality of the arising woven web; namely thereby the warp threads are loaded, the interlacing point can wander, and start-up marks can arise in the woven web upon the renewed running-up of the weaving machine with its reed beat-ups. One therefore strives to keep as short as possible, the time in which the loom shed stands in the open position during operating malfunctions or interferences. Therefore, whenever possible, outside of the normal weaving operation, the loom shed is brought into the closed position.

SUMMARY OF THE INVENTION

It is the underlying object of the present invention, upon an operating interference or malfunction, to shorten the time duration for the elimination of the operating malfunction, and to avoid as much as possible the slowdown of the shedding machine and the rotating masses connected therewith and the possibly present inertial masses down to a standstill. In connection with operating malfunctions due to weft break, thereby the time duration with an open position of the loom shed is further shortened, and moreover less electrical energy is needed, because the shedding machine does not need to be stopped and then again set into operation, in order to eliminate or remove a weft break.

The above object is achieved in a method of operating a weaving machine with a shedding machine according to the invention with the features set forth herein. In that regard, the shedding machine is further operated with a high working rotational speed, e.g. the previous operating rotational speed, and if the weft break elimination was successful, it is then transitioned again into the regular weaving operation, without stopping.

In the prior art, for starts, stops and rotational speed changes of the weaving and shedding machine with drives that are independent from one another, it is already suggested not to also operate or drive the shedding means for certain reasons, and e.g. to leave the shedding means standing preferably in an open shed position with a running-up or running-down shedding machine.

According to the present invention, in connection with an operating interference or malfunction, with a shedding machine that continues to run, the shedding means are activated or deactivated in a suitable manner via a programmable process sequence control, so that a broken weft thread can be removed and then again newly inserted. In that regard, only the weaving machine is reduced in its rotational speed and if applicable brought completely to a standstill by the control of its own drive. Then the weaving machine with its own drive again runs up to the operating rotational speed desired for the further weaving operation, and in that regard synchronizes itself with the shedding machine, which already runs with this operating rotational speed, so that the weaving operation is again further carried on in a pattern-correct manner.

For certain reasons it can be necessary that the operating rotational speed of the weaving and shedding machine at the first reed beat-up after an operating malfunction must be different from the operating rotational speed at the last reed beat-up before an operating malfunction. This can, for example, be based on the fact that the control of the weaving machine is programmed in such a manner so that it automatically reduces the operating rotational speed of the weaving and shedding machine upon the occurrence of a large number of successive operating malfunctions, until fewer operating malfunctions arise. An opposite process is naturally also conceivable in connection with less frequent operating malfunctions. Moreover, there may be other weaving technical requirements that require a different operating rotational speed of the weaving and shedding machine upon the first reed beat-up after an operating malfunction than upon the last reed beat-up before the operating malfunction. For this reason it is also provided within the scope of the method according to the invention, to adapt the rotational speed of the shedding machine to the requirements that are prescribed by the weaving machine control, before again taking up the regular pattern-correct weaving operation, that is to say, to reduce or to increase the rotational speed of the shedding machine within certain limits, so that it again runs essentially synchronously with, that is to say with the operating rotational speed of, the weaving machine, which carries out the reed beat-ups, in the following regular weaving operation. To this also belongs, if applicable, an adjusting of the angular relationship or the relative position between the weaving machine and the shedding machine. Due to weaving technical reasons, it can be necessary to change this angular relationship or relative position in the working cycle of the weaving and shedding machine at the time point of the closed position of the loom shed for the further regular weaving operation, either permanently or also from weft pick to weft pick. A phase shifting takes place between the working cycles of weaving and shedding machine. That must be taken into consideration, if applicable, upon the renewed synchronisation after an operating malfunction, by a suitable programming of the controls of the drive motors, but does not change anything in the essentially synchronous operating manner in the normal weaving operation of the weaving and shedding machine.

Under certain conditions, for eliminating or removing the causes for the operating malfunction it can also be necessary to reduce the rotational speed of the shedding machine during the non-synchronous operation of weaving and shedding machine. In order that the advantage of the method claimed here still remains existing, one will avoid a standstill of the shedding machine, however; it is sensible not to reduce the rotational speed of the shedding machine below 50% of the operating rotational speed.

It can furthermore be sensible, to further operate also the weaving machine at a low rotational speed at least temporarily during the non-synchronous operation of weaving and shedding machine, in order to enable the removal or elimination of the causes of the operating malfunction. This can, for example, be necessary when one wishes to bring the weaving reed of the weaving machine into a certain position for the automatic removal of weft breaks. During the described process, the weaving machine will be run down to a creeping speed that is e.g. compatible with the weft break removal (that is to say sufficiently slow). In the present case, the term creeping speed means rotational speeds that are smaller than 10% of the normal operating rotational speed. The removal of an operating malfunction, e.g. the weft break removal, can take place automatically or manually by the weaving mill personnel. Automatic weft break removal, e.g. by means of air jet, is the state of the art in modern weaving machines and does not need to be described here in more detail. For the case of the manual removal of operating malfunctions, for safety reasons in the scope of the method described here, correspondingly adapted method process sequences will be necessary. The operation of the weaving machine with a low rotational speed (creeping gear) and again taking up the normal weaving operation after weft break removal can, e.g., be first started by corresponding input at the operating console of the weaving machine by the weaving mill personnel.

The desired operating types pre-programmed in the control and regulating arrangement, as well as the rotating speeds of weaving and shedding machine during and after performing the measures for the removal of an operating malfunction are pre-selectable by the operator by corresponding input menus or keys on the control and regulating arrangement of weaving and shedding machine.

In connection with longer operating interruptions, e.g. in connection with an unsuccessful attempt to remove or eliminate the cause of an operating malfunction, the weaving and shedding machine are stopped. The loom shed is then brought to a closed position as soon as possible by suitable control of the drive of the shedding machine and corresponding actuation of the shedding means. In connection with operating malfunctions that do not require a weft break removal and thus also do not require an open position of the loom shed, the driving or operation to a closed position of the loom shed can similarly be achieved very early, namely while the shedding machine is still being run down or slowed down, that is to say has not yet come to a standstill after recognition of the operating malfunction. This can be sensible, for example, in connection with an operating interference due to a warp break. The inventive method has particular advantages for the case that the cause of the operating malfunction is a weft break on the weaving machine. According to the prior art, this is signaled by a transducer to the control and regulating arrangement of the weaving machine, which can thereby recognize whether or not a weft thread has been properly inserted. Namely, certain positions of the shedding means, which form the loom shed, are necessary for the removal of a broken weft pick out of the loom shed and the renewed insertion of this broken weft pick into the pattern-correct loom shed. These are achieved according to the method according to the invention without a standstill of the shedding machine by activating or deactivating the movement of the shedding means. In connection with a weft break, e.g. for removing the broken weft thread, the loom shed must be in that pattern-correct position which existed upon the insertion of this broken weft pick into the loom shed. Thereafter, this weft pick must be inserted anew and the pattern-correct weaving operation must be continued with the next weft pick. It is, however, to be considered, that in connection with the interrupted synchronisation between weaving and shedding machine and in connection with rotational speed reduction or complete run-down of the weaving machine, the activation of the shedding means with a still-running shedding machine may only take place, if no collision with mechanical weft insertion elements (e.g. grippers) that might possibly still be present in the loom shed can still occur. If applicable, one or more signal transducers are to be provided, which detect the position of the insertion elements and transmit signals to the control of the weaving or the shedding machine, which prevent or interrupt an activation of the shedding means, as long as the danger of a collision with the insertion elements exists.

For weaving technical reasons it can be generally sensible, to carry out a so-called start with missing or lost pick after an operating malfunction or a longer standstill of the weaving machine. In that regard, the weaving machine starts up without a weft pick being inserted, that is to say the last previous correctly inserted weft pick experiences anew a reed beat-up, preferably however only this one, for which the weaving machine starts within one weaving cycle. Before that, the shedding means must be brought into that pattern-correct open position of the loom shed that was necessary for inserting this last weft pick into the loom shed. With independent drives for weaving and shedding machine it is possible to carry out any desired movements of the shedding means driven by the shedding machine, without the weaving machine being moved thereby. That is to say, no undesirable reed beat-ups become necessary, for example with a slow reverse running of the weaving machine into the necessary starting position.

The described start with a lost or missing pick may now be integrated in an advantageous further development in the method according to the invention for operating a weaving machine with a shedding machine, if this option is required for the renewed start of the weaving process after an operating malfunction. Described in connection with an example of an operating malfunction due to weft break, this further development of the method is represented as follows: While carrying out the measures for the weft break removal, the shedding machine is further operated with a high working rotational speed, and after removal of the broken weft thread it brings the loom shed of the last correctly inserted weft thread into an open position and thus freely exposes this weft thread. For that purpose, the associated shedding means are activated or deactivated in a suitable manner. During this process, on its part the weaving machine can already be located in the starting phase or it only starts after complete opening of this shed. In any case, the weaving machine with its drive starts again to the operating rotational speed desired for the further weaving operation and is synchronized with the independent drive of the shedding machine by the control after completion of the measures for removing the operating malfunction, whereby the shedding machine then also runs with this operating rotational speed, so that the weaving operation is again carried on in a pattern-correct manner. In this process, the weaving machine control receives a signal that no weft pick is to be inserted before the first reed beat-up, which can be carried out by corresponding electromechanical devices of modern gripper or air jet weaving machines.

It can also occur that several weft picks are inserted with faults or breaks before the weaving machine with drive is stopped by its stop motions or monitoring devices and the process of the weft break removal is started. In this case, the method described here is to be carried out analogously for several broken or incorrectly inserted weft picks. For that, with the shedding machine running and the weaving machine stopped or operating in the creeping gear, the shedding means must be brought into the correct pattern-dependent open positions of the loom shed by activation or deactivation of their motion one after another, in order to be able to remove the associated weft picks.

The desired sequence of the measures for the removal of an operating malfunction, which are pre-programmed in the control and regulating arrangement, is selectable by the operator by corresponding input menus or keys on the control and regulating arrangement of the weaving and shedding machine.

DETAILED DESCRIPTION OF EXAMPLE EMBODIMENTS OF THE INVENTION

Figure 1:
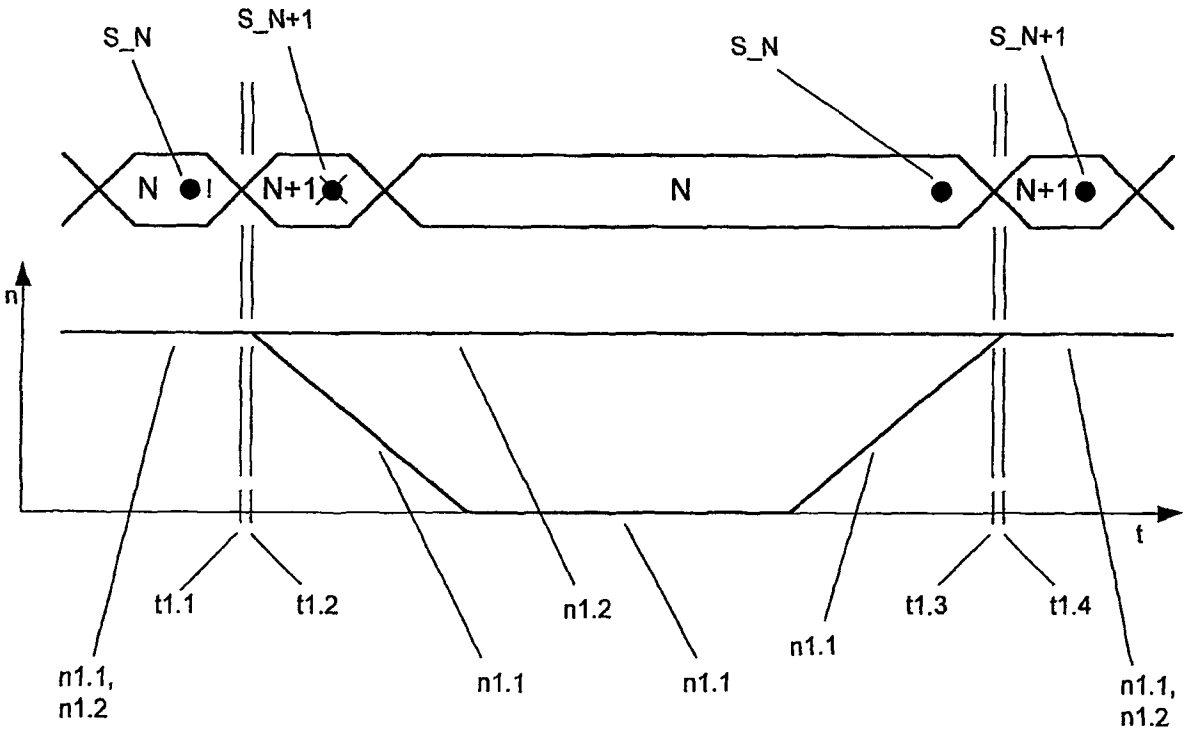
FIG. 1 diagram of the method sequence according to the invention in connection with weft break removal FIG. 2 diagram as in FIG. 1, however weaving machine in creeping gear FIG. 3 diagram as in FIG. 1, however start with lost or missing weft pick FIG. 4 diagram as in FIG. 1, however an optional process sequence for weaving machines with mechanical insertion elements is illustrated FIG. 5 diagram as in FIG. 1, however with different operating rotational speed before and after the operating malfunction FIG. 6 diagram as in FIG. 1, additionally illustrated is a renewed interruption of the operation without the inventive method following.

FIG. 1 shows an initially or presently running weaving operation, in which the operating rotational speed n1.1 of the weaving machine and n1.2 of the shedding machine are equally large. The weft thread S_N inserted into the loom shed N breaks (!) that is to say it is not correctly inserted. The change from loom shed N to loom shed N+1 will still be completed in most cases, because it is no longer stoppable in the usual case at high operating rotational speed due to the inertially moving masses, that is to say the switching command or instruction for the shedding means movement to the loom shed N cannot be carried out so quickly that loom shed N simply remains open. The closed position of the shedding means that are in motion at the change from loom shed N to N+1 is thus run through at the time point t1.1, e.g. 330° (with respect to the weaving machine angle, which runs through 360° in one weaving cycle) is a common practical value for the closed position of the loom shed.

At the time point t1.2, which may e.g. occur together with the reed beat-up of the weaving machine, thus 360°, the braking process of the weaving machine begins. In the illustrated case, the weaving machine is braked down to a standstill, that is to say n1.1 is then=0. As a result of the above described loom shed change, the loom shed N+1 is now open. The associated weft thread S_N+1 is here not inserted (X), because of course the weft thread S_N that was not correctly inserted (or was broken) must first be removed. Therefore, through a corresponding actuation of the shedding means, it is changed back to the loom shed N. The incorrectly inserted weft thread can now be removed manually or by a so-called automatic weft break removal. During the entire process, the shedding machine has not changed its operating rotational speed n1.2, that is to say it is still the same as that with which it was operated also already up to the beginning of the occurrence of the weft break. The drive for the shedding machine must thus not provide a power or torque peak for a braking process. The corresponding time is also saved; only the weaving machine, which brakes more quickly due to lower rotational masses or without additional inertial masses, has been stopped.

Once the broken or incorrectly inserted weft thread is removed, then the weaving machine starts again. In the example, the point as of which the weaving and shedding machine are again synchronously operated with the same rotational speed and in the manner required for the regular weaving operation was set to the reed beat-up, which falls on the time point t1.4. Shortly before t1.4, t1.3 is run through, which specifies the time point for the closed position of the loom shed. The weft thread S_N is correspondingly to be inserted at a proper time before t1.3, so that it can properly move through the loom shed and finally be bound up.

Figure 2:
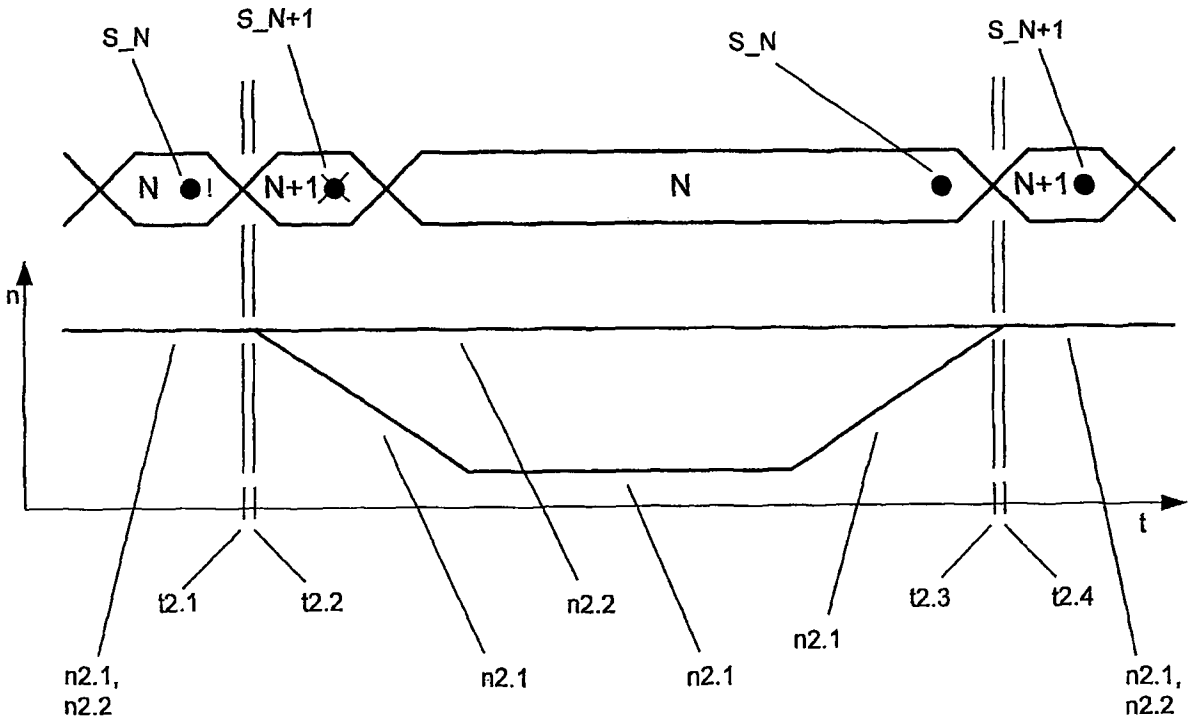

FIG. 2 shows an initially or presently running weaving operation as illustrated in FIG. 1. At the time point t2.2, which e.g. can occur together with the reed beat-up of the weaving machine, thus 360°, the braking process of the weaving machine begins. In the illustrated case, the weaving machine is braked down to a creeping rotational speed, that is to say n2.1 is than>0. The further method proceeds analogously to FIG. 1. During the entire process, the shedding machine has not changed its operating rotational speed n2.2, that is to say it is still the same as that with which it was operated also already up to the beginning of the occurrence of the weft break. Only the comparably substantially more quickly braking weaving machine has been braked down to the creeping gear speed.

If several weft threads are broken or not correctly inserted, then first the loom shed of the last broken weft pick is opened, as this has occurred in FIGS. 1 and 2 for the weft thread S_N. If this weft thread has been removed in a manual manner (whereby the weaving machine preferably has been braked down to a standstill), then preferably by inputs of the operator on the weaving machine, the shedding means of the further running shedding machine are actuated one after another in such a manner that all further sheds are opened and the weft picks can be removed, until also the first broken weft thread S_N−i (with i>0) can be removed. After this removal, the weaving machine is started again; the weft thread S_N−i is inserted into the corresponding opened loom shed N−i; time point t1.3 specifies the time point for the closed position of the loom shed, which is run through in the course of the loom shed change from N−i to N−i+1; at the time point t1.4 the weft thread S_N−i is beat-up.

If the last broken weft thread was automatically removed, then all further sheds are opened and the weft threads are removed preferably also in an automatic manner with a running shedding machine, until also the first broken weft thread S_N−i (with i>0) can be removed. After this removal, the weaving machine starts again automatically; either from the standstill or from the creeping motion. If its starts from the standstill, then the point as of which the weaving and shedding machine are again synchronously operated with the same rotational speed and in the manner required for the operation falls at t1.4. Shortly before t1.4, t1.3 is run through, which specifies the time point of the closed position of the loom shed. If it starts from the creeping motion, then the point as of which the weaving and shedding machine again is synchronously operated with the same rotational speed and in the manner required for the operation falls at t2.4. Shortly before t2.4, t2.3 is run through, which specifies the time point for the closed position of the loom shed.

Figure 3:
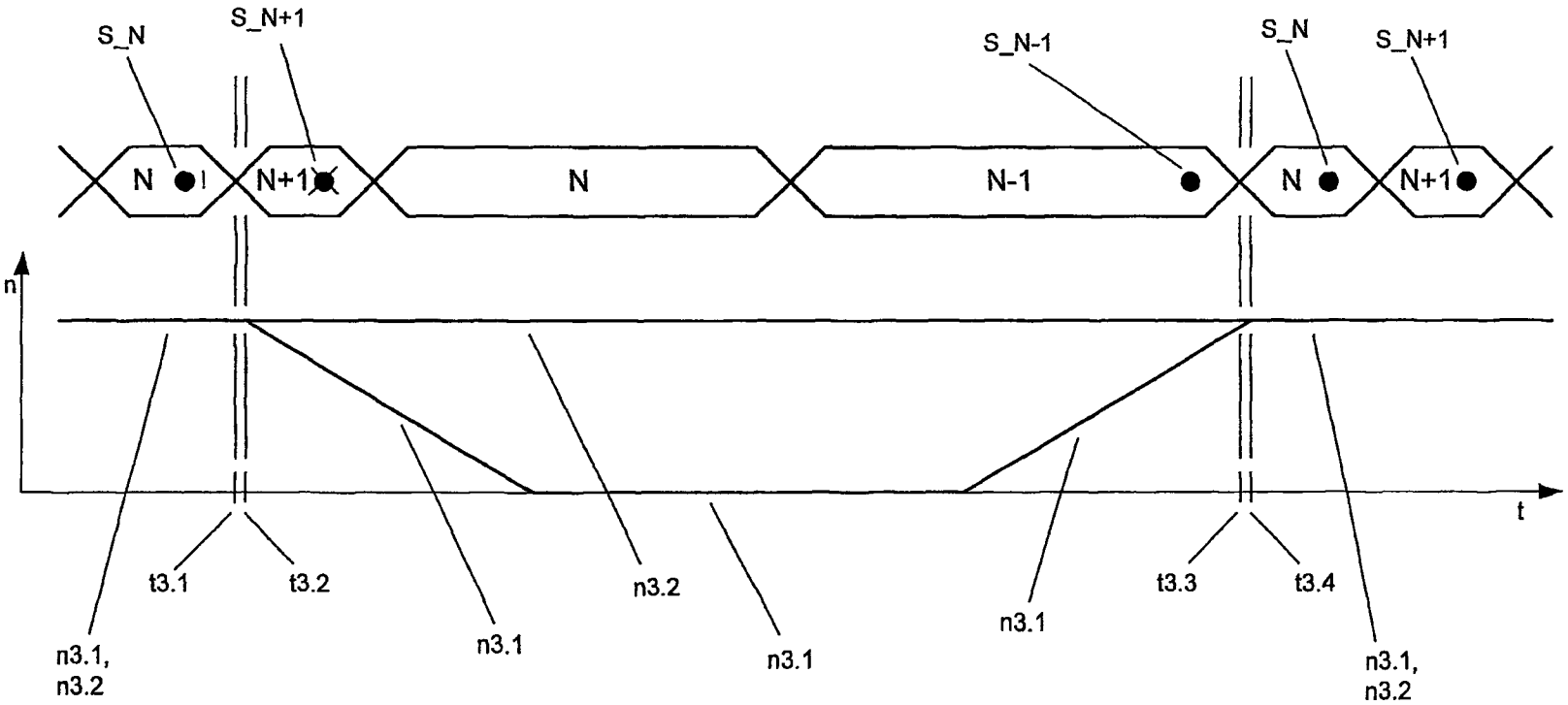

FIG. 3 shows initially or presently running weaving operation as in the preceding examples. The weft thread S_N inserted into the loom shed N breaks, that is to say it is not correctly inserted. At the time point t3.2, which can occur together with e.g. the reed beat-up of the weaving machine, thus 360°, the braking process of the weaving machine begins. In the illustrated case, the weaving machine is braked down to a standstill, that is to say n3.1 is then=0. During the entire further process, the shedding machine has not changed its rotational speed n3.2, that is to say it is still equal to that with which it was operated also already up to the beginning of the occurrence of the weft break. If the broken weft thread is removed, a change is made to the loom shed N−1 and thereby the last correctly inserted weft thread S_N−1 is freely exposed. Then the weaving machine starts again. At the time point t3.4, the weft thread S_N−1 is beat-up by the weaving reed. This uncovering or exposing of a weft thread (here S_N−1) that has previously already been beat-up by the weaving reed, in order to bind or interlace it and beat it up anew in the course of the restarting, is often seen in practice as a start with missing or lost pick. In the course of the again running weaving operation, a change is made from the loom shed N−1 to the loom shed N, in order to insert the weft pick N. The further weft threads beginning with N+1 will then also be inserted in the typical weaving technical manner.

Figure 4:
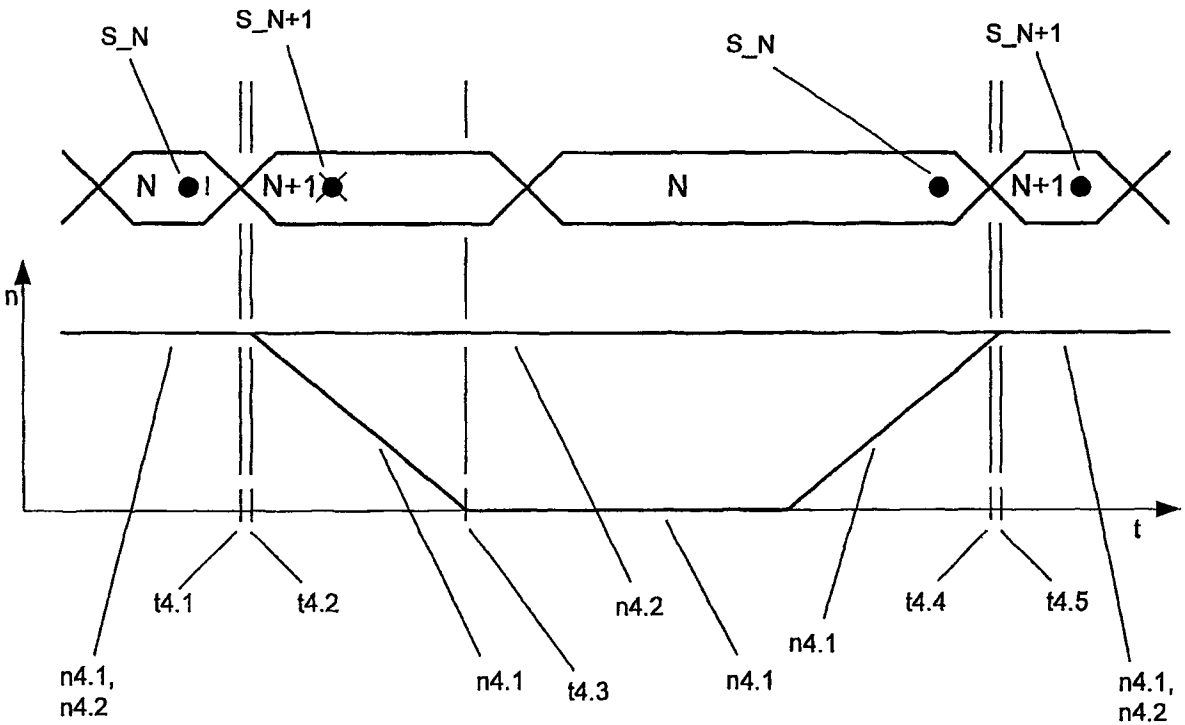

FIG. 4 shows a modification of the example 1 (FIG. 1) for weaving machines with mechanical weft insertion system (weft insertion system based on flexible band or tape grippers and/or rigid rod or rapier grippers) or weft insertion system based on weaving shuttles or projectiles. In that regard, the loom shed N+1 is held open so long until no collision danger with elements of the weft insertion still exists, due to a change to the loom shed N. In the example, for a rigid rod or rapier gripper or flexible band gripper weaving machine, a means e.g. position and/or rotational speed transducer, is provided, which detects the standstill of the weaving machine that took place at the time point t4.3. In that regard, the standstill position is selected so that the flexible band gripper or the rigid rod or rapier gripper are located completely outside of the loom shed. Only then is the change to the loom shed N permitted by control means. The remaining process sequence is identical to FIG. 1; the following correspond with one another: (t4.1 and t1.1), (t4.2 and t1.2): (t4.4 and t1.3); (t4.5 and t1.4); (n4.1 and n1.1); (n4.2 and n1.2).

Figure 5:
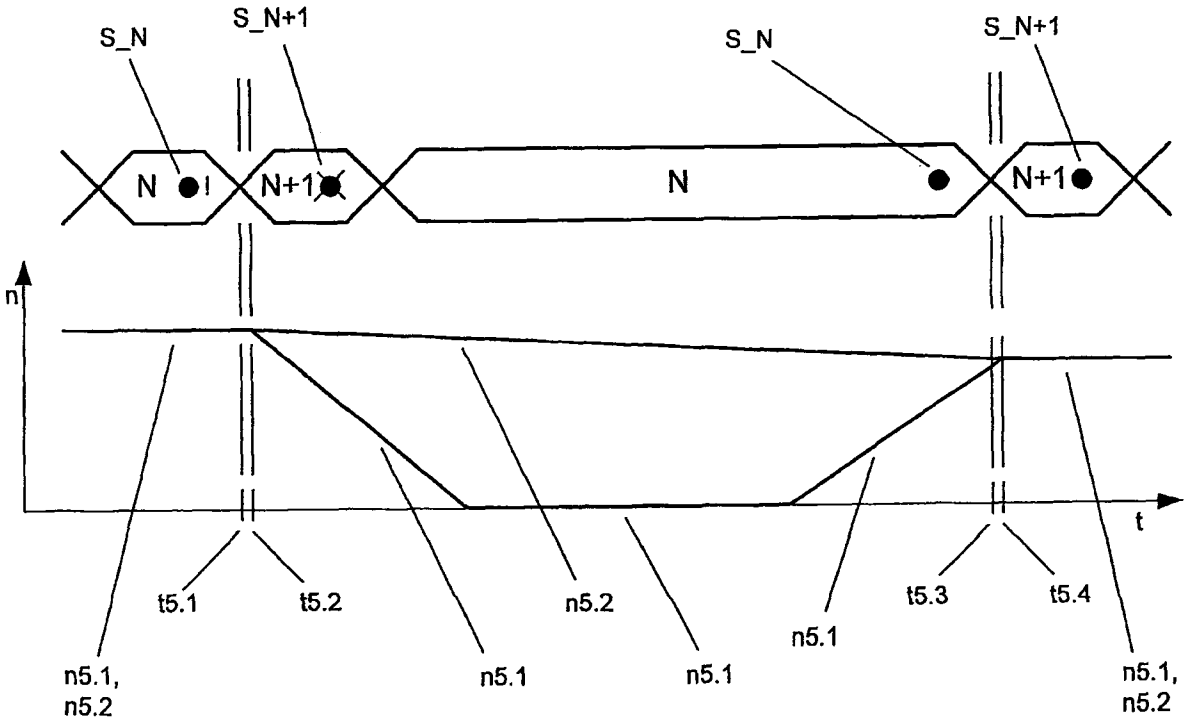

Also FIG. 5 shows a modification of the example embodiment 1 (FIG. 1). The modification consists in that the operating rotational speeds n5.1 of the weaving machine and n5.2 of the shedding machine are different ones at the time point t5.4 than at the time point t5.2. In that regard, t5.4 is the time point of the first reed beat-up after insertion of the weft S_N, which before was not correctly inserted and therefore had to be removed; the time point t5.2 corresponds to t1.2. The fact that n5.1, n5.2, as shown, are smaller at t5.4 than at t5.2 often has its practical meaning in the avoidance of start-up marks. Thus, e.g., it can be required to beat-up the first weft thread after (re)starting with only 90% of the otherwise provided rotational speed (see time point t5.2). Furthermore the following correspond to one another: t5.1 and t1.1 as well as t5.3 and t1.3.

Figure 6:
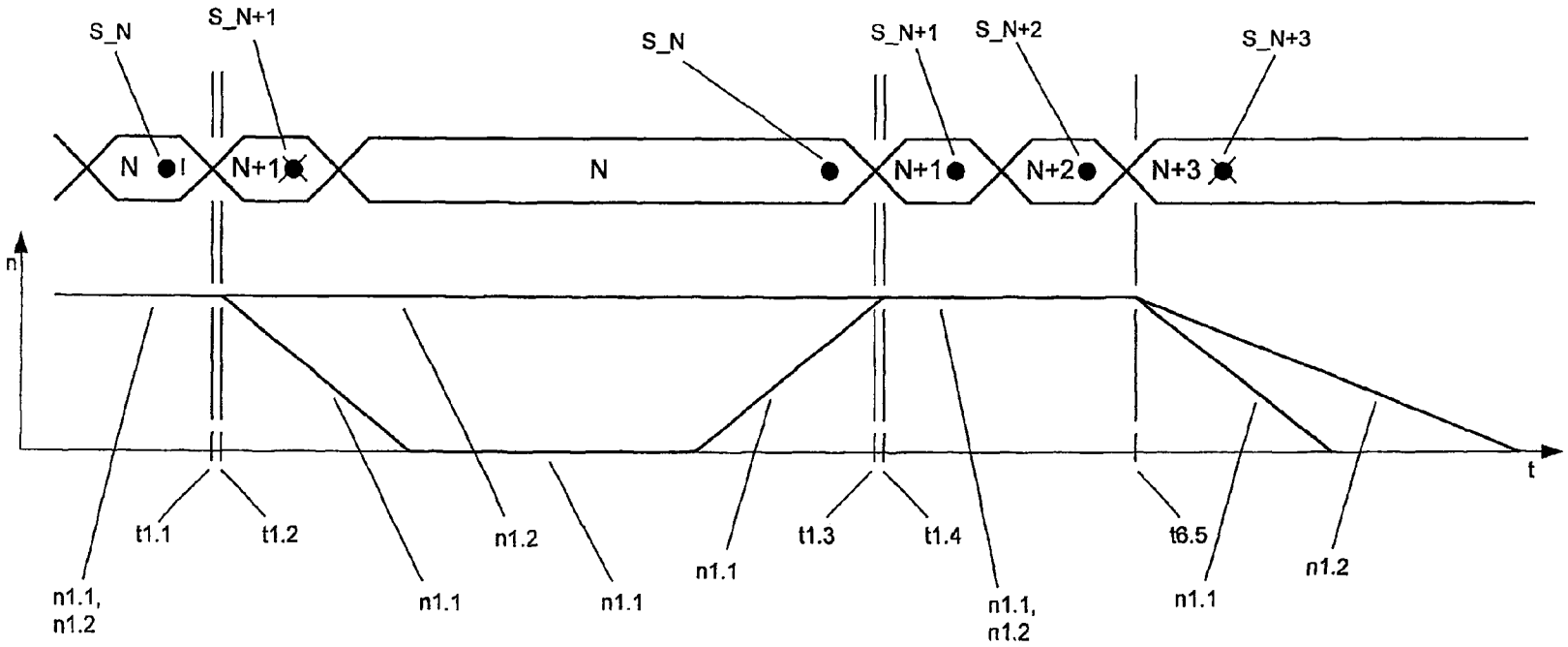
Figure 7:
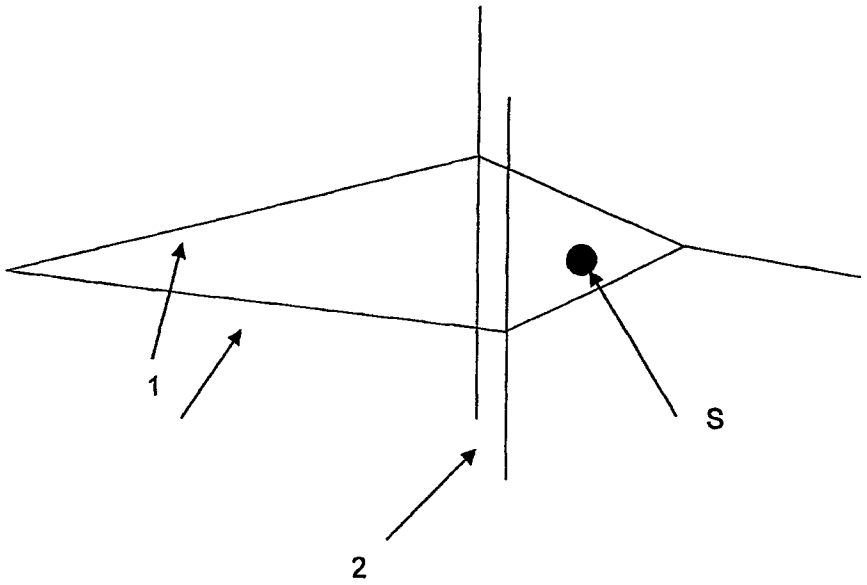
FIG. 7 section through a weaving machine, view in the weft insertion direction, with a loom shed that is formed of warp threads (1), which are deflected by shedding means (2) so that a weft thread (S) can be inserted.

In the process sequence, FIG. 6 corresponds to FIG. 1, but additionally shows a stop following shortly thereafter, which stop does not lead to the method according to the invention, which becomes apparent as of the time point t6.5 by a corresponding slowdown of weaving and shedding machine down to a standstill. The weft thread S_N+3 is no longer inserted. In this example, the loom shed remains in an open position. Of course the control of the shedding machine can also be programmed in such a manner so that during the slowdown of the weaving and shedding machine, the motion of the shedding means is actuated in such a manner so that the loom shed is in a closed position upon a standstill of weaving and shedding machine.

The invention claimed is:

1. A weaving method carried out on an apparatus including a weaving machine, a shedding machine and a control arrangement, wherein the weaving machine includes a rotational-speed changeable weaving drive, the shedding machine includes shedding devices that are selectively drivable by a single rotational-speed changeable shedding drive, and the control arrangement is arranged and adapted to respectively control the shedding drive and the weaving drive independently of one another, wherein the weaving method comprises the steps:

a) carrying out a normal weaving operation, comprising operating the weaving drive to drive the weaving machine at a normal operating rotational speed and operating the shedding drive to drive the shedding machine, in essential synchronism with one another through control of the control arrangement;

b) during the normal weaving operation, detecting an operating malfunction;

c) in response to the detecting of the operating malfunction, through the control arrangement releasing the essential synchronism and reducing a rotational speed of the weaving machine to below the normal operating rotational speed;

d) further in response to the detecting of the operating malfunction, through the control arrangement controlling movements of the shedding devices to enable elimination of the operating malfunction;

e) in conjunction with the step d), performing measures to eliminate the operating malfunction;

f) continuing to operate the shedding drive at or above a specified positive rotational speed and continuing to drive the shedding machine so that the shedding machine does not come to a standstill throughout the steps c), d) and e); and g) after eliminating the operating malfunction in the step e), through the control arrangement increasing the rotational speed of the weaving machine to a new operating rotational speed and resuming weaving operation with the shedding machine in essential synchronism with the weaving machine.

2. The weaving method according to claim 1, wherein the detecting of the operating malfunction in the step b) occurs at a first time point, the resuming of the normal weaving operation in the step g) occurs at a second time point, the step f) is carried out so that a rotational speed of the shedding machine remains at or above the specified positive rotational speed at all times from the first time point to the second time point, and the specified positive rotational speed is at least 50% of the smaller of a first operating speed value of the shedding machine that exists at a reed beat-up carried out by the weaving machine next following the first time point and a second operating speed value of the shedding machine that exists at another reed beat-up carried out by the weaving machine next following the second time point.

3. The weaving method according to claim 1, wherein the operating malfunction comprises a weft fault involving a faulty weft thread, the step d) comprises controlling the movements of the shedding devices to open a fault-involved loom shed into which the faulty weft thread had been inserted, then the measures in the step e) comprise removing the faulty weft thread from the fault-involved loom shed after it has been opened, then the method further comprises operating the weaving machine to insert a replacement weft thread into the fault-involved loom shed after the faulty weft thread has been removed, then the step d) further comprises controlling the movements of the shedding devices to bind-in the replacement weft thread and to open a next subsequent loom shed required for insertion of a pattern-correct next weft thread following the replacement weft thread.

4. The weaving method according to claim 3, wherein the weft fault involves plural successive faulty weft threads in plural successive fault-involved loom sheds, and the steps d) and e) are repeated successively to remove the plural successive faulty weft threads one after another.

5. The weaving method according to claim 1, wherein the step d) comprises controlling the movements of the shedding devices to successively open previous loom sheds back to a pattern-correct open position of a last loom shed into which a last non-faulty weft thread had been correctly inserted before the operating malfunction was detected, then the step d) further comprises controlling the movements of the shedding devices to close the last loom shed so as to again bind-in the last non-faulty weft thread and then to open a next subsequent loom shed required for insertion of a pattern-correct next weft thread following the last non-faulty weft thread.

6. The weaving method according to claim 5, wherein the weft fault involves plural successive faulty weft threads in plural successive fault-involved loom sheds, and the steps d) and e) are repeated successively to remove the plural successive faulty weft threads one after another.

7. The weaving method according to claim 1, wherein the step c) comprises reducing the rotational speed of the weaving machine to zero to achieve a standstill of the weaving machine at least temporarily during the step e).

8. The weaving method according to claim 1, wherein the step c) comprises reducing the rotational speed of the weaving machine to a positive creep speed to achieve a creeping operation of the weaving machine at least temporarily during the step e).

9. The weaving method according to claim 8, wherein the rotational speed of the weaving machine remains greater than zero throughout the steps c), d), e), f) and g).

10. The weaving method according to claim 1, wherein the step f) comprises continuing to operate the shedding drive and the shedding machine, throughout the steps c), d) and e), at a normal shedding machine operating speed at which the shedding machine was operating in the normal weaving operation when the operating malfunction was detected in the step b).

11. The weaving method according to claim 1, wherein in the step b) the shedding machine is operating at a normal shedding machine operating speed when the operating malfunction is detected, and the step f) comprises smoothly slowing the shedding machine from the normal shedding machine operating speed to a reduced shedding machine operating speed at which the shedding machine is to be operated when resuming the weaving operation in the step g).

12. The weaving method according to claim 1, wherein the new operating rotational speed for resuming the weaving operation in the step g) is less than the normal operating rotational speed in the step a).

13. The weaving method according to claim 1, wherein the new operating rotational speed for resuming the weaving operation in the step g) corresponds to the normal operating rotational speed in the step a).

14. The weaving method according to claim 1, wherein the operating malfunction comprises a weft fault.

15. The weaving method according to claim 1, wherein the operating malfunction comprises a warp fault.

16. An apparatus comprising:

a weaving machine including a rotational-speed changeable weaving drive, and weft insertion devices;

a shedding machine including shedding devices that are selectively drivable by a single rotational-speed changeable shedding drive;

a control arrangement connected to the weaving drive and to the shedding drive, and arranged and adapted to respectively control the weaving drive and the shedding drive independently of one another;

sensors connected in a signal transmitting manner with the control arrangement, wherein the sensors are selected from weft fault sensors, warp fault sensors, and position sensors adapted to sense a position of the weft insertion devices; and an input arrangement adapted to enable an operator to input or select process sequences of measures to eliminate an operating malfunction, and adapted to enable the operator to input or select an operating manner and a rotational speed of the weaving machine and of the shedding machine during and after performance of the measures to eliminate the operating malfunction;

wherein:

during normal weaving operation, the control arrangement is adapted to control the weaving drive and the shedding drive to operate the weaving machine and the shedding machine in essential synchronism with one another at a normal operating rotational speed, upon receiving an operating malfunction signal from at least one of the sensors, the control arrangement is adapted to release the essential synchronism between the weaving machine and the shedding machine and to reduce a rotational speed of the weaving machine to below the normal operating rational speed, and is further adapted to control movements of the shedding devices to enable elimination of the detected operating malfunction according to the process sequences of the measures to eliminate the operating malfunction, which were input or selected via the input arrangement, while continuing to operate the shedding drive at or above a specified positive rotational speed and continuing to drive the shedding machine so that the shedding machine does not come to a standstill, and upon receiving a clearance signal from at least one of the sensors, the control arrangement is adapted to increase the rotational speed of the weaving machine to a new operating rotational speed and bring the shedding machine into essential synchronism with the weaving machine according to the operating manner and the rotational speed, which were input or selected via the input arrangement.

* * * * *